US011473449B2

(12) United States Patent
Lefebvre

(10) Patent No.: US 11,473,449 B2
(45) Date of Patent: Oct. 18, 2022

(54) TURBINE CASING FOR GAS TURBINE ENGINE

(71) Applicant: PRATT & WHITNEY CANADA CORP., Longueuil (CA)

(72) Inventor: Guy Lefebvre, St-Bruno-de-Montarville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/087,306

(22) Filed: Nov. 2, 2020

(65) Prior Publication Data

US 2022/0136408 A1 May 5, 2022

(51) Int. Cl.

| | |
|---|---|
| ***F01D 25/24*** | (2006.01) |
| ***F01D 25/30*** | (2006.01) |
| ***F01D 9/06*** | (2006.01) |
| ***F01D 25/16*** | (2006.01) |

(52) U.S. Cl.

CPC ..... *F01D 25/243* (2013.01); *F01D 25/30* (2013.01); *F05D 2230/21* (2013.01); *F05D 2230/25* (2013.01); *F05D 2230/60* (2013.01); *F05D 2240/14* (2013.01); *F05D 2260/31* (2013.01)

(58) Field of Classification Search

CPC ..... F01D 25/243; F01D 25/24; F01D 25/246; F01D 25/28; F01D 25/30; F01D 25/164; F01D 9/041; F01D 9/042; F01D 9/00; F01D 9/02; F01D 9/023; F04D 29/522; F04D 29/644; F05B 2260/301; F02C 7/20; F05D 2220/32; F05D 2230/21; F05D 2230/25; F05D 2300/505; F05D 2230/60; F05D 2230/64; F05D 2240/14; F05D 2260/31; F05D 2260/30

See application file for complete search history.

(56) References Cited

U.S. PATENT DOCUMENTS

| | | | |
|---|---|---|---|
| 8,561,415 | B2 | 10/2013 | Fontaine et al. |
| 9,587,519 | B2 | 3/2017 | Salunkhe et al. |
| 2006/0053799 | A1 | 3/2006 | Aycock et al. |

(Continued)

FOREIGN PATENT DOCUMENTS

| | | | |
|---|---|---|---|
| FR | 965697 | A | 9/1950 |

OTHER PUBLICATIONS

European Search Report issued in counterpart application 21206045.3 dated Mar. 30, 2022.

*Primary Examiner* — Eric J Zamora Alvarez

(74) *Attorney, Agent, or Firm* — Norton Rose Fulbright Canada LLP

(57) ABSTRACT

A casing assembly includes first case with a first case body at least partially disposed in a hot section. The first case body has a first case flange and the first case body adjacent to the first case flange is resiliently deformable. A second case downstream of the first case has a second case body with a second case flange extending radially outwardly to a radially-outer wall defining an outer diameter of the second case flange. The first case flange abuts the radially-outer wall of the second case flange. The second case has struts extending radially from an inner end to an outer end. The leading edge portion at the outer end of each of the struts has an axial position defined along the center axis that is similar to an axial position of the second case flange.

17 Claims, 3 Drawing Sheets

(56) References Cited

U.S. PATENT DOCUMENTS

| | | | | |
|---|---|---|---|---|
| 2012/0297791 | A1* | 11/2012 | Suciu | F02K 1/04 60/796 |
| 2018/0087395 | A1* | 3/2018 | Harding | F01D 9/041 |
| 2018/0230856 | A1* | 8/2018 | Eastwood | F01D 11/005 |

* cited by examiner

TURBINE CASING FOR GAS TURBINE ENGINE

TECHNICAL FIELD

The application relates generally to gas turbine engines and, more particularly, to turbine casing arrangements for such engines.

BACKGROUND

During operation of gas turbine engines, parts of the engine are exposed to the hot combustion gases. During transient events, such as when the gas turbine engine is started, the temperature of these parts may rapidly increase from a relative cold temperature to the hot temperature of the combustion gases.

The rapid increase in temperature of the parts exposed to the hot combustion gases may cause them to undergo thermal expansion. If these parts are mounted to other components which do not experience such a rapid increase in temperature, a thermal mismatch may result and may lead to thermally-induced stresses.

SUMMARY

There is disclosed a turbine casing assembly, comprising: a turbine support case (TSC) having a TSC body defined about a center axis with a TSC flange, the TSC body adjacent to the TSC flange being resiliently deformable; and an exhaust case having an exhaust case body defined about the center axis with an exhaust case flange extending radially outwardly from the exhaust case body to a radially-outer wall defining an outer diameter of the exhaust case flange, the exhaust case flange configured to be secured to the TSC flange to abut the TSC flange against the radially-outer wall of the exhaust case flange and attach the TSC to the exhaust case, the exhaust case having struts circumferentially spaced apart about the center axis, each of the struts extending radially from an inner end to an outer end attached to the exhaust case body, each of the struts extending between a leading edge portion and a trailing edge portion, the leading edge portion at the outer end of each of the struts having an axial position defined along the center axis that is similar to an axial position of the exhaust case flange.

There is disclosed a gas turbine engine, comprising: a hot section of the gas turbine engine having a rotor with rotor blades rotatable about a center axis of the gas turbine engine; a first case with a first case body defined about the center axis and at least partially disposed in the hot section, the first case body having a first case flange and the first case body adjacent to the first case flange being resiliently deformable; and a second case downstream of the first case and having a second case body defined about the center axis with a second case flange extending radially outwardly from the second case body to a radially-outer wall defining an outer diameter of the second case flange, the second case flange secured to the first case flange and the first case flange abutting the radially-outer wall of the second case flange, the second case having struts circumferentially spaced apart about the center axis, each of the struts extending radially from an inner end to an outer end attached to the second case body, each of the struts extending between a leading edge portion and a trailing edge portion, the leading edge portion at the outer end of each of the struts having an axial position defined along the center axis similar to an axial position of the second case flange.

There is disclosed a method of assembling a turbine casing of a gas turbine engine, the method comprising: abutting a flange of a turbine support case (TSC) against a flange of an exhaust case to abut part of the flange of the TSC against an outer diameter surface of the flange of the exhaust case, and to position leading edge portions of struts of the exhaust case at positions along a center axis being similar to a position of the flange of the exhaust case along the center axis; and securing the flanges of the TSC and the exhaust case together to assemble the TSC with the exhaust case, the assembled TSC and exhaust case configured to displace together with a resiliently deformable portion of the TSC adjacent to the flange of the TSC.

DESCRIPTION OF THE DRAWINGS

Reference is now made to the accompanying figures in which.

DETAILED DESCRIPTION

Figure 1A:
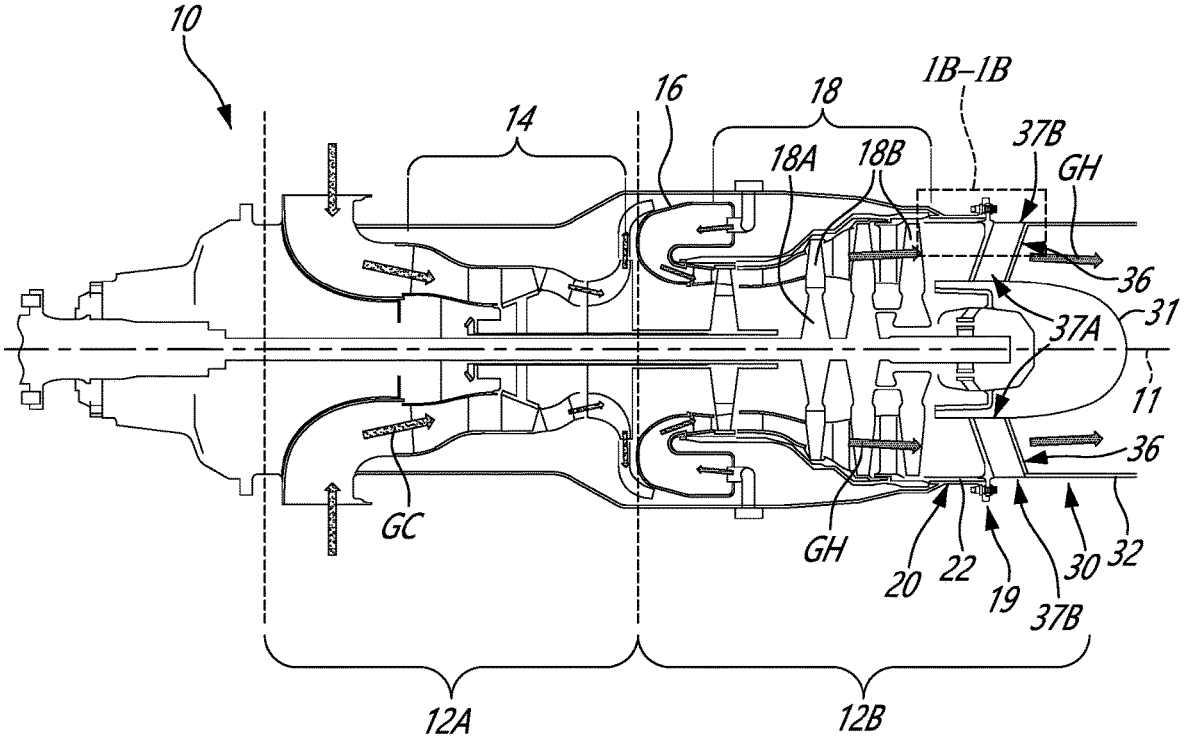
FIG. 1A is a schematic cross-sectional view of a gas turbine engine.

FIG. 1A illustrates a gas turbine engine 10 of a type preferably provided for use in subsonic flight, generally comprising in serial flow communication a compressor section 14 for pressurizing the air, a combustor 16 in which the compressed air is mixed with fuel and ignited for generating an annular stream of hot combustion gases, and a turbine section 18 for extracting energy from the combustion gases. Some of the rotatable components of the gas turbine engine 10 rotate about a longitudinal center axis 11 of the gas turbine engine.

The gas turbine engine 10 has a "cold" section 12A and a "hot" section 12B. The cold section 12A includes those components of the gas turbine engine 10 which are upstream (relative to the direction gases flow through the gas turbine engine 10) of the combustor 16 and have thus not been exposed to the hot combustion gases. The hot section 12B includes the combustor 16 and those components of the gas turbine engine 10 which are downstream of the combustor 16. The components of the hot section 12B are thus exposed to the hot combustion gases generated in the combustor 16. The gases GC flowing through the cold section 12A have a lower temperature than the gases GH flowing through the hot section 12B.

Referring to FIG. 1A, the hot section 12B includes the combustor 16, the turbine section 18 and a case downstream of the turbine section 18 for conveying the exhaust gases. The turbine section 18 includes one or more rotors 18A each having rotor blades 18B which rotate about the center axis 11 and extract energy from the combustion gases. The rotors 18A and rotor blades 18B of the turbine section are typically referred to as turbines and turbine blades, respectively. The hot section 12B includes stationary bodies which enclose other components of the hot section 12B and define the gas path for the hot combustion gases. These stationary bodies are sometimes referred to as casings or cases which collectively define radially-outer boundaries of the gas turbine engine.

Referring to FIG. 1A, the casing of the gas turbine engine 10 includes a turbine casing assembly 19 which is part of the hot section 12B. The turbine casing assembly 19 is a group of casing components that form part of the turbine section 18 and enclose the combustion gases. The turbine casing assembly 19 may be provided as disassembled cases which may then be assembled in a suitable facility. The turbine casing assembly 19 includes a first case 20 and a second case 30. In the embodiment of FIG. 1A, the first case 20 is a turbine support case (TSC) and is thus sometimes referred to herein as "turbine support case 20" or "TSC 20". In the embodiment of FIG. 1A, the second case 30 is an exhaust case 30 for conveying the hot exhaust gases, and is mounted to the TSC 20. It will be appreciated that the first and second cases 20,30 may be other cases of the hot section 12B. For example, in one possible alternate configuration, the first case 20 houses the combustor 16 and part of the components of the cold section 12A, and the second case 30 houses the rotors 18A and stators of the turbine section 18.

Figure 1B:
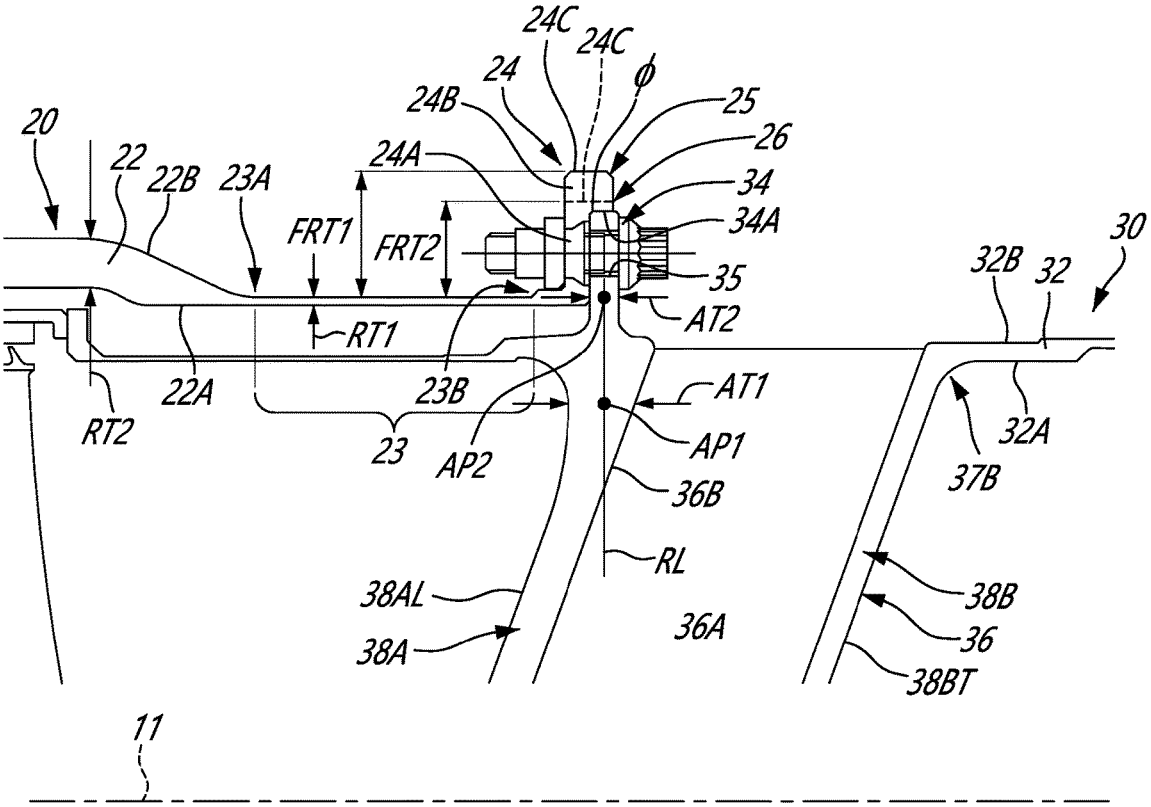
FIG. 1B is an enlarged cross-sectional view of region IB-IB of FIG. 1A.

Referring to FIG. 1A, the TSC 20 forms part of the casing for the gas turbine engine 10. The TSC 20 houses stationary and rotatable components of the turbine section 18 such as the rotor blades 18B, disks, or stator vanes of the turbine section 18, and defines part of the gas path for the hot combustion gases through the turbine section 18. The TSC 20 has a TSC body 22 which provides structure to the TSC 20 and forms the corpus thereof. In FIG. 1A, the TSC body 22 is cylindrical about the center axis 11. In FIG. 1A, the TSC body 22 defines part of an annular gas path for the hot combustion gases through the turbine section 18. Referring to FIG. 1B, the TSC body 22 includes an inner wall 22A disposed radially inwardly (i.e. closer to the center axis 11) of an outer wall 22B. A radial thickness of the TSC body 22 is defined between the inner and outer walls 22A,22B.

Referring to FIG. 1B, the TSC body 22 has one or more TSC flanges 24. The TSC flange 24 is a radially-protruding body that is configured for mating with, and being secured to, corresponding structure of the exhaust case 30 in order to assemble the TSC 20 and the exhaust case 30. In FIG. 1B, the TSC flange 24 extends radially outwardly from a radially-outermost outer surface of the TSC body 22. In FIG. 1B, the TSC flange 24 extends radially outwardly from the outer wall 22B of the TSC body 22. In FIGS. 1A and 1B, a radially-outermost surface of the TSC flange 24 is substantially parallel to the center axis 11 and defines an outer diameter of the TSC flange 24. In FIGS. 1A and 1B, a radially-outermost surface of the TSC flange 24 is substantially parallel to the center axis 11 and defines an outer diameter of the TSC body 22.

Referring to FIG. 1B, a portion 23 of the TSC body 22 adjacent to the TSC flange 24 is resiliently deformable. Referring to FIG. 1B, the portion 23 is immediately adjacent to the TSC flange 24. The portion 23 is immediately upstream of the TSC flange 24. The portion 23 has an axial extent, and extends in a direction being substantially parallel to the center axis 11. Referring to FIG. 1B, the portion 23 extends axially between an upstream extremity 23A and a downstream extremity 23B that is integral with the TSC flange 24. The portion 23 extends axially upstream from the TSC flange 24. The portion 23 is a cylindrical body which forms only a segment of the axial extent of the TSC body 22.

By "resiliently deformable", it is understood that the portion 23 displaces by deforming temporarily and returns to its original shape in response to a radial displacement of parts of the exhaust case 30 due to thermal expansion, as described in greater detail below. The temporary deformation of the portion 23 is caused by the displacement of TSC flange 24 resulting from the thermal expansion of the exhaust case 30. The portion 23 returns to its default shape and position when thermal expansion has ceased. The portion 23 thus acts like a hinge to accommodate temporary thermal expansion of the exhaust case 30. The resilient deformability of the portion 23 may result from its material composition, from the technique used to manufacture the portion 23, from its dimensional arrangement, and/or from any combination of the preceding factors.

Referring to FIG. 1B, the resilient deformability of the portion 23 results at least in part from a difference in the radial thickness of the TSC body 22 adjacent to the TSC flange 24. The portion 23 has a first radial thickness RT1 defined between the inner and outer walls 22A,22B of the TSC body 22 along the axial extent of the portion 23. The first radial thickness RT1 is constant along the axial extent of the portion 23. A remainder of the TSC body 22, or possibly just a segment of the TSC body 22 immediately adjacent to the portion 23, has a second radial thickness RT2 that is greater than the first radial thickness RT1. Thus, in FIG. 1B, the resilient deformability of the portion 23, and thus of the TSC flange 24 connected thereto, is derived at least in part from a thinner cylindrical portion of the TSC body 22 acting as a hairpin structure adjacent to the TSC flange 24 to improve the flexibility of the TSC flange 24 during thermal expansion of mating components. The resilient deformability of the portion 23 may also result from the technique used to manufacture the portion 23. For example, the portion 23 may be forged metal. Forging a metal involves shaping the metal using localized compressive forces. For example, a hammer, or another tool for applying compressive forces such as a die, may compress the portion 23 so that the grains of the metal have the properties and orientation to achieve the functionality described above. In an embodiment, the TSC body 22 is a forged metal.

Referring to FIGS. 1A and 1B, the exhaust case 30 forms part of the casing for the gas turbine engine 10. The exhaust case 30 is disposed downstream of the TSC 20 and mounted thereto. The exhaust case 30 houses stationary components of the hot section 12B such as an exhaust cone 31, and defines part of an annular gas path for the exhaust gases after the combustion gases have been exhausted through the turbine section 18. The exhaust case 30 has an exhaust case body 32 which provides structure to the exhaust case 30 and forms the corpus thereof. In FIG. 1A, the exhaust case body 32 is cylindrical about the center axis 11. Referring to FIG. 1B, the exhaust case body 32 includes an inner wall 32A disposed radially inwardly (i.e. closer to the center axis 11) of an outer wall 32B. A radial thickness of the exhaust case body 32 is defined between the inner and outer walls 32A,32B.

Referring to FIG. 1B, the exhaust case body 32 has one or more exhaust case flanges 34. The exhaust case flange 34 is a radially-protruding body that is configured for mating with, and being secured to, the TSC flange 24 in order to assemble the TSC 20 and the exhaust case 30. In FIG. 1B, the exhaust case flange 34 extends radially outwardly from a radially-outermost outer surface of the exhaust case body 32 to a radially-outer wall 34A of the exhaust case flange 34. In FIG. 1B, the exhaust case flange 34 extends radially outwardly from the outer wall 32B of the exhaust case body 32. In FIGS. 1A and 1B, the radially-outer wall 34A defines a radially-outermost surface of the exhaust case flange 34 and is substantially parallel to the center axis 11. The radially-outer wall 34A defines the outer diameter Ø of the exhaust case flange 34. The radially-outer wall 34A defines the outer diameter Ø of the exhaust case body 32.

Referring to FIG. 1B, when the TSC and exhaust case flanges 24,34 are mating and secured together such that the TSC 20 and the exhaust case 30 are assembled together, some or all of the TSC flange 24 abuts against the radially-outer wall 34A of the exhaust case flange 34, and against other portions of the exhaust case flange 34 as well. The TSC flange 24 radially overlaps the exhaust case flange 34 at its outer diameter Ø. The TSC and exhaust case flanges 24,34 thus form a flange/joint arrangement that includes an interface along the outer diameter Ø of the exhaust case flange 34. This tight fit at the outer diameter Ø helps to maintain the mating faces of the TSC and exhaust case flanges 24,34 in abutment through the application of compressive forces on the mating faces during thermal expansion of part of the exhaust case 30, as described in greater detail below, through all engine running conditions.

Figure 2A:
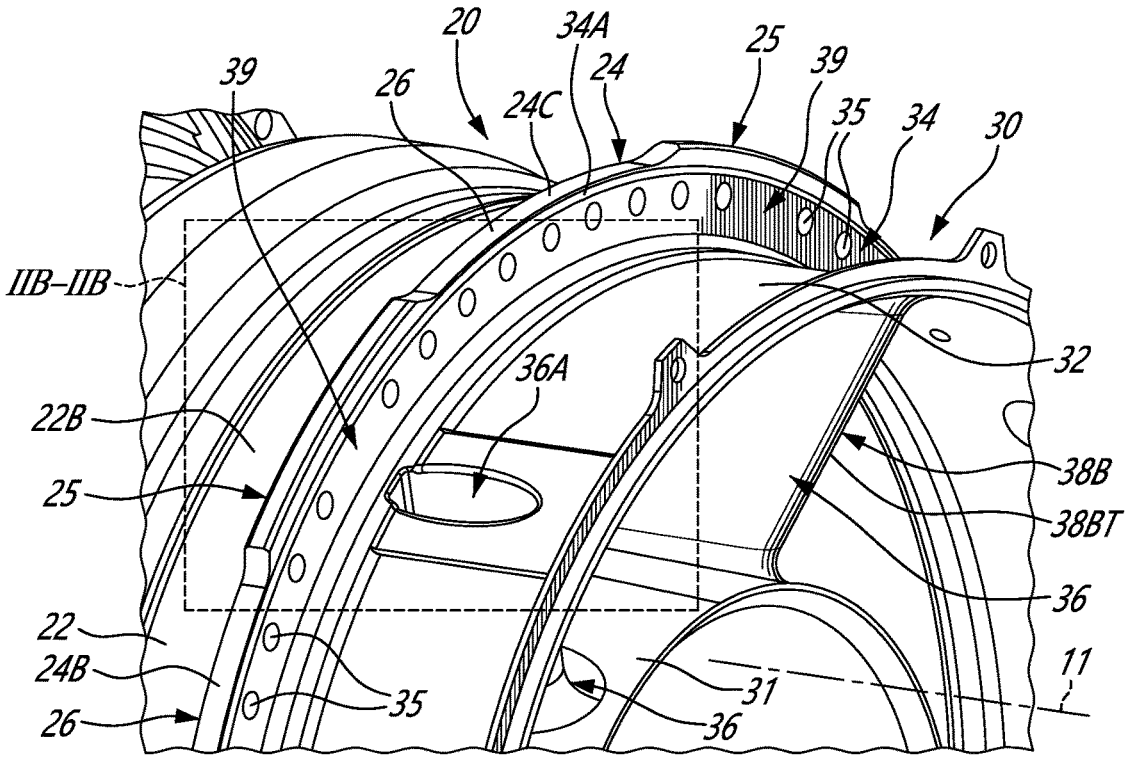
FIG. 2A is a perspective view of part of the turbine support case and exhaust case of the gas turbine engine of FIG. 1A.

Different configurations for the mating engagement of the TSC flange 24 with the radially-outer wall 34A of the exhaust case flange 34 are possible. For example, and referring to FIG. 1B, the TSC flange 24 includes a first portion 24A extending radially outwardly from the outer wall 22B of the TSC body 20. The first portion 24A extends along a line being radial to the center axis 11. A radially-overlapping second portion 24B of the TSC flange 24 extends axially away from, and downstream of, the first portion 24A. The second portion 24B abuts against the radially-outer wall 34A of the exhaust case flange 34. A radially-innermost wall of the second portion 24B abuts against the radially-outer wall 34A of the exhaust case flange 34. The second portion 24B abuts against the radially-outer wall 34A of the exhaust case flange 34 over all of the axial extent of the radially-outer wall 34A. The second portion 24B is disposed radially-outwardly from the radially-outer wall 34A. A downstream surface of the first portion 24A of the TSC flange 24 mates with and abuts against an upstream surface of the exhaust case flange 34. Referring to FIGS. 1B and 2A, the second portion 24B of the TSC flange 24 abuts against the radially-outer wall 34A along all of the circumferential periphery of the radially-outer wall 34A. The TSC flange 24 thus radially overlaps the exhaust case flange 34 continuously over the entire periphery of the exhaust case flange 34. The radial overlap of the TSC flange 24 over the radially-outer wall 34A is 360 degrees. Similarly, the first portion 24A of the TSC flange 24 abuts against the remainder of the exhaust case flange 34 along all of the circumferential periphery of the exhaust case flange 34.

Other configurations for the mating engagement of the TSC flange 24 with the radially-outer wall 34A of the exhaust case flange 34 are possible. For example, the TSC flange 24 may radially overlap the exhaust case flange 34 in a non-continuous manner, such as over circumferentially discrete and spaced apart portions of the exhaust case flange 34, for example in circumferential locations where struts 36 of the exhaust case 30 are positioned. In yet another possible configuration of the engagement of the TSC flange 24 with the radially-outer wall 34A, the TSC flange 24 includes only one inclined portion extending from the outer wall 22B of the TSC body 20 at an angle to a plane being perpendicular to the center axis 11, the inclined portion of the TSC flange 24 abutting against only an upstream portion of the radially-outer wall 34A.

Referring to FIGS. 1A and 1B, the exhaust case 30 has struts 36 that reinforce the exhaust case body 32. The struts 36 are distributed circumferentially about the center axis 11. The struts 36 are circumferentially spaced apart from each other by the same circumferential distance. Each of the struts 36 extends along a substantially radial direction. By "substantially radial direction", it is understood that the magnitude of the dimension of each strut 36 defined along a line radial to the center axis 11 is greater than the magnitude of the dimension of each strut 36 defined along a line that is parallel to the center axis 11. Each strut 36 extends radially from an inner end 37A to an outer end 37B disposed radially outwardly of the inner end 37A. The inner end 37A of each strut 36 is connected to the exhaust cone 31. In an alternate embodiment, the inner end 37A is mounted to a shaft with a suitable bearing, or to another stationary or rotatable structure adjacent to the center axis 11. The outer end 37B of each strut 36 is connected to, or integral with, the exhaust case body 32. The outer end 37B of each strut 36 is the radially-outermost extremity of the strut 36. It will be appreciated that the struts 36 may be integrally formed with the exhaust case body 32 to form a single component exhaust case 30.

Referring to FIG. 1B, each of the struts 36 extends in a substantially axial direction between a leading edge portion 38A and a trailing edge portion 38B. By "substantially axial direction", it is understood that the directional vector of the chord between the leading and trailing edge portions 38A, 38B of each strut 36 has a magnitude defined along a line parallel to the center axis 11 that is is much greater than the magnitude of the directional vector defined along a line that is radial to the center axis 11. The leading edge portion 38A includes the leading edge 38AL of the strut 36 as well as the portion of the body of the strut 36 immediately adjacent to the leading edge 38AL. Similarly, the trailing edge portion 38B includes the trailing edge 38BT of the strut 36 as well as the portion of the body of the strut 36 immediately adjacent to the trailing edge 38BT. The leading and trailing edge portions 38A,38B are defined relative to the direction of flow of exhaust gases across the strut 36 and through the exhaust case 30, with the leading edge portion 38A being upstream relative to the flow and encountering the flow before the downstream trailing edge portion 38B. One or more of the struts 36 may define an airfoil that is symmetric or asymmetric about the chord defined between the leading and trailing edges 38AL,38BT.

Figure 2B:
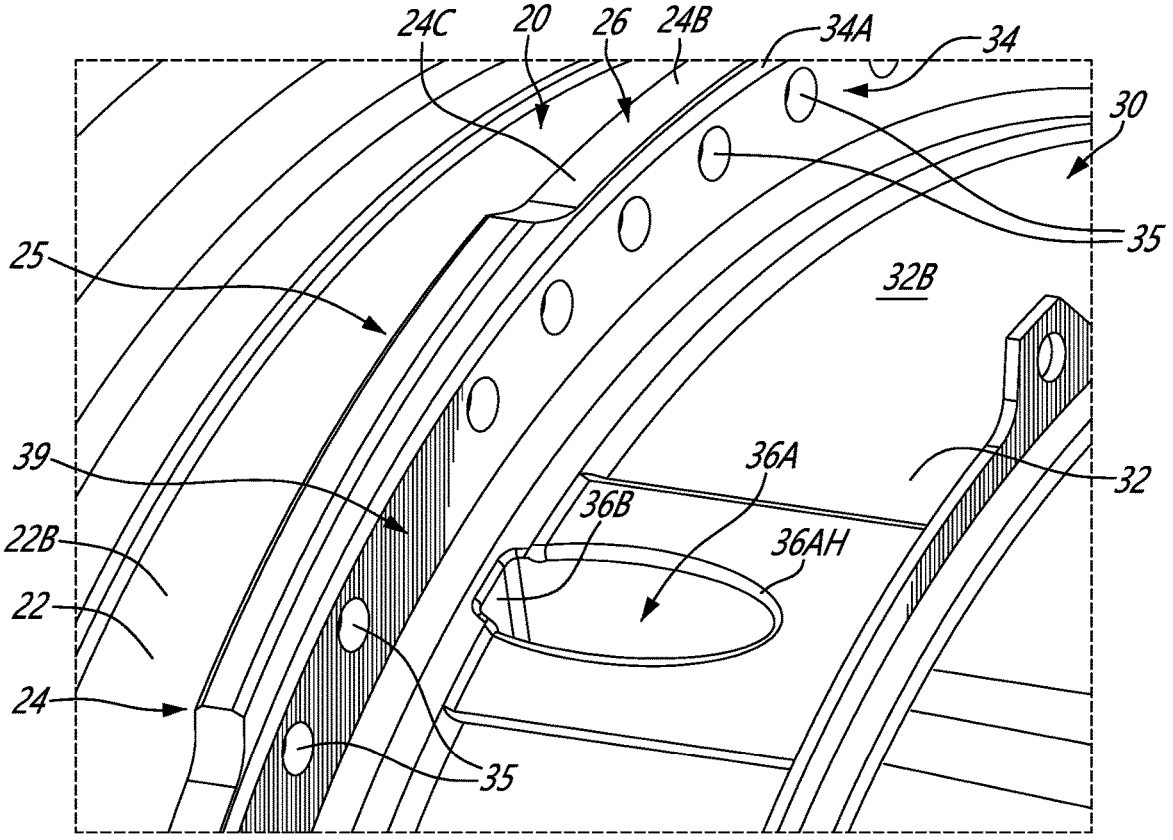
FIG. 2B is an enlarged perspective view of region IIB-IIB of FIG. 2A.

Referring to FIG. 1B, the strut 36 is hollow and defines an internal cavity 36A. Oil service lines, coolant, probes and any other suitable object may extend through the cavity 36A of the strut 36. Referring to FIG. 2B, the cavity 36A forms an opening 36AH at the outer wall 32B of the exhaust case body 32 through which objects may be inserted into the cavity 36A. The cavity 36A is delimited by an internal cylindrical or annular wall 36B. An axial thickness of the strut 36 at the leading edge portion 38A is defined along a line parallel to the center axis 11 between the leading edge 38AL and the axially closest portion of the annular wall 36B. An axial thickness of the strut 36 at the trailing edge portion 38B is defined along a line parallel to the center axis 11 between the trailing edge 38BT and the axially closest portion of the annular wall 36B. In an alternate embodiment, some or all of the strut 36 is filled internally if the weight envelope permits.

Referring to FIG. 1B, the leading edge portion 38A of at least the outer end 37B of each of the struts 36 is axially aligned with the exhaust case flange 34. The leading edge portion 38A at the outer end 37B of each of the struts 36 has a leading edge axial position AP1 defined relative to the center axis 11 that is similar to a flange axial position AP2 of the exhaust case flange 34. The leading edge and flange axial positions AP1,AP2 are measured relative to the center axis 11. The leading edge axial position AP1 may be one of the following: the axial position of the leading edge 38AL at the outer end 37B, the axial position of the internal annular wall 36B at the outer end 37B of the leading edge portion 38A, or the midpoint between the two preceding positions. Similarly, the flange axial position AP2 may be one of the following: the axial position of an upstream surface of the exhaust case flange 34, the axial position of a downstream surface of the exhaust case flange 34, or the midpoint between the two preceding positions. It will be appreciated that the axial thicknesses of the leading edge portion 38A at the outer end 37B and of the exhaust case flange 34 are small relative to the overall dimensions of the exhaust case 30. Therefore, the axial positions of the thin leading edge portion 38A and of the thin exhaust case flange 34 vary very little over their respective axial extents.

The term "similar" is used herein to convey that the leading edge and flange axial positions AP1,AP2 may be identical, or may differ from each other by a relatively small amount such that at least a portion of the leading edge portion 38A at the outer end 37B of the strut 36 is positioned radially inwardly of the exhaust case flange 34 along a radial line RL extending from, and perpendicular to, the center axis 11 through the exhaust case flange 34. For example, and referring to FIGS. 1A and 1B, the axial position of the leading edge portion 38A is not constant, and varies between the inner and outer ends 37A,37B of each strut 36. In such a configuration, and as shown in FIG. 1B, at least part of the leading edge portion 38A at the outer end 37B of the strut 36 lies along the radial line RL and defines the leading edge axial position A1. Referring to FIG. 1A, the axial position of the leading edge portion 38A varies between the inner and outer ends 37A,37B of each strut 36. The axial position of the leading edge portion 38A at the inner end 37A is upstream of the axial position of the leading edge portion 38A at the outer end 37B. It thus follows that part of the leading edge portion 38A of the strut 36 may be axially misaligned with the exhaust case flange 34, but the leading edge portion 38A at the outer end 37B of the strut 36 is axially aligned with the exhaust case flange 34. In an alternate configuration of the strut 36, the leading edge portion 38A extends along a line radial to the center axis 11, such that all of the leading edge portion 38A is axially aligned with the exhaust case flange 34.

The axial alignment of the outer end 37B of the leading edge portion 38A of the struts 36 with the exhaust case flange 34, and with the joint formed by the TSC and exhaust case flanges 24,34, allows any radial expansion of the strut 36 to be transmitted substantially radially outwardly to the exhaust case flange 34, thereby helping to reduce or eliminate any moment on the exhaust case flange 34 that may be caused by the radial expansion of the strut 36. The exhaust case 30 thus provides a structure where the mating flanges 24,34 are positioned directly radially outwardly of some or all of the leading edge 38AL of the struts 36. The leading edge 38AL of the struts 36 is at least partially axially aligned with the point of attachment between the TSC 20 and the exhaust case 30.

Figure 3A:
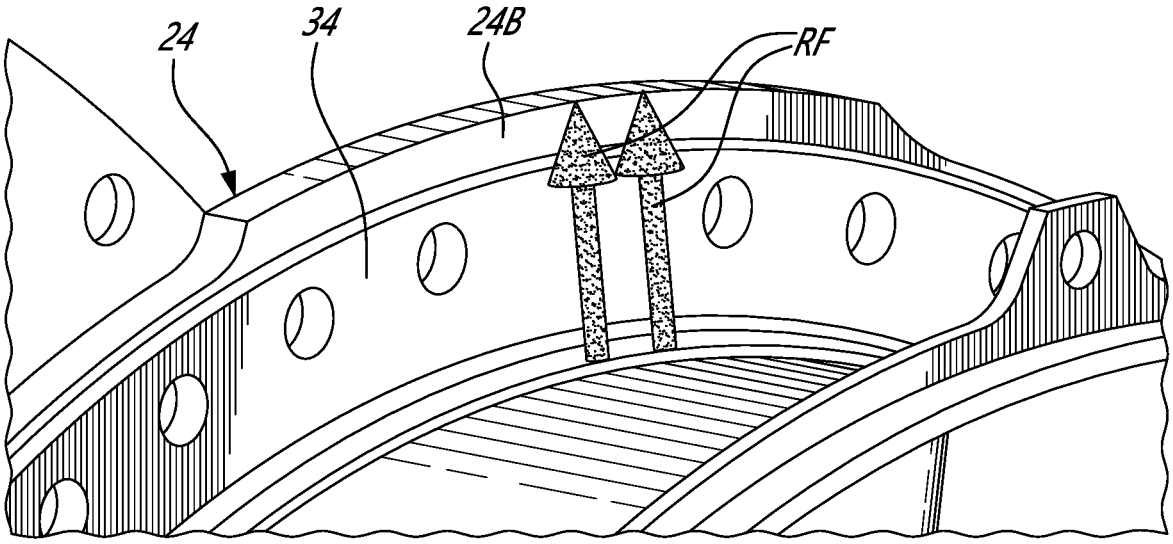
FIG. 3A a schematic view of part of the exhaust case of FIG. 1A showing forces of thermal deformation.
Figure 3B:
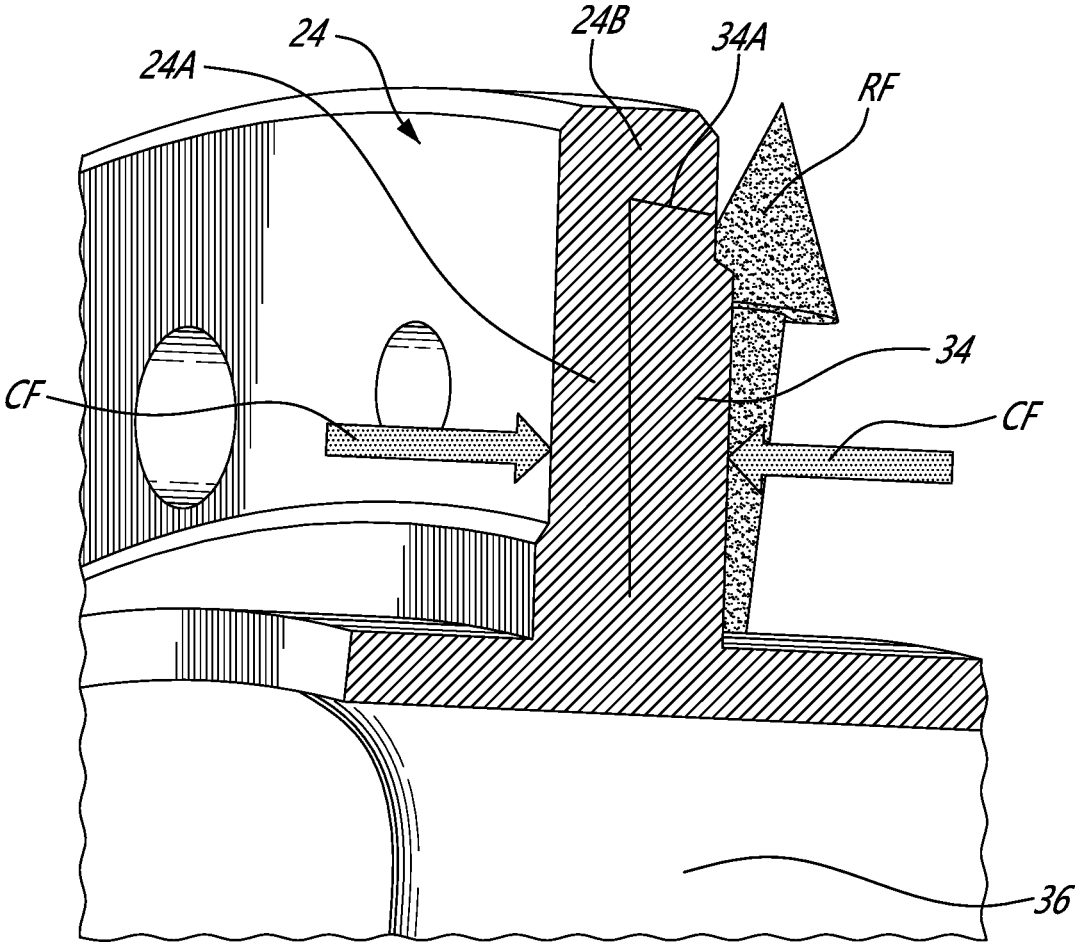
FIG. 3B is an enlarged cross-sectional view of FIG. 3A showing compressive forces acting on the turbine support case and exhaust case.

Referring to FIGS. 1A and 1B, when the gas turbine engine 10 undergoes a transient event, such as when the gas turbine engine 10 goes from being off to started up, the hot gases GH flowing through the exhaust case 20 heat up the struts 36 very quickly, particularly in compact engine designs. The struts 36 are heated more than the TSC 20 such that there is a thermal mismatch between the exhaust case 30 and the TSC 20. The heated struts 36 are caused to thermally expand radially outwardly. The axial alignment of at least the outer end 37B of the leading edge portion 38A helps to direct the expansion of the struts 36 radially outwardly to the exhaust case flange 34. Referring to FIGS. 3A and 3B, the radially-outward expansion of the struts 36 applies a radial force RF against the exhaust case flange 34. Since the radially-outer wall 34A of the exhaust case flange 34 is radially overlapped by part of the TSC flange 24, the radial force RF is applied against the second portion 24B of the TSC flange 24. The application of the radial force RF against the second portion 24B causes the first portion 24A of the TSC flange 24 and the exhaust case flange 34 to be squeezed together under compressive forces CF. Any radial displacement of the attached TSC and exhaust case flanges 24,34 is accommodated by the resiliently deformable portion 23 of the TSC body 22, which displaces by deforming temporarily in response to the radial displacement of the attached TSC and exhaust case flanges 24,34.

The TSC 20 and exhaust case 30 disclosed herein help to allow the TSC 20 near the attached flanges 24,34 to be flexible to accommodate thermal expansion of the struts 36. This allows for transferring most or all of the deformation of the struts 36 to the attached or mated TSC 20. The TSC 20 is thus designed to be flexible to accommodate the radial expansion of the struts 36. The TSC 20 and exhaust case 30 disclosed herein help to reduce or eliminate bending or deflection into the exhaust case body 32 and thus avoid high tensile stress into the material of the exhaust case 30. This may help to provide a solution to a transient thermal stress issue, which may be more common on gas turbine engines 10 which are compact relative to the center axis 11. The TSC 20 and exhaust case 30 disclosed herein may thus contribute to allowing for the installation of an exhaust duct 30 in an extreme high temperature and compact area of the gas turbine engine 10.

The mated TSC 20 and exhaust case 30 may have additional features which contribute to the functionalities described above. For example, and referring to FIGS. 2A and 2B, the exhaust case flange 34 is a single continuous body that extends around the entire circumferential periphery of the exhaust case body 32. Similarly, the TSC flange 24 is a single continuous body that extends around the entire circumferential periphery of the TSC body 22. The flanges 24,34 are thus circumferentially continuous. In such an embodiment, the continuous exhaust case flange 34 includes holes 35 being through holes that extend through the axially-spaced apart walls of the exhaust case flange 34. The holes 35 are configured to be aligned with corresponding holes in the TSC flange 24 (see FIG. 1B) and to receive therethrough a bolt secured in the holes with a nut, thereby attaching the TSC 20 to the exhaust case 30. The holes 35 are disposed on the exhaust case flange 34 circumferentially about the center axis 11. As explained in greater detail below, most of the holes 35, but not all, are spaced circumferentially from an adjacent hole 35 by the same circumferential distance. Referring to FIG. 2B, the exhaust case flange 34 includes portions 39 each one of which is circumferentially aligned with one of the struts 36. By "circumferentially aligned", it is understood that the strut 36 has the same circumferential position, defined about the center axis 11, as some or all of the corresponding portion 39 of the exhaust case flange 34. Referring to FIG. 2B, each portion 39 has a circumferential extent defined between two holes 35. Each portion 39 is a segment of the exhaust case flange 34 that is continuous.

Each portion 39 is a segment of the exhaust case flange 34 that is free of holes 35. Each portion 39 of the exhaust case flange 34 is axially aligned with the leading edge portion 38A of the strut 36 and is free of holes 35. The circumferential distance between the holes 35 is largest over the portions 39, and is equal between the holes 35 everywhere else in the exhaust case flange 34. The exhaust case flange 34 thus has a structure in which attachment holes 35 are omitted in line with each strut 36. This structure helps to reinforce the exhaust case flange 34 at the location where the radial force RF from the thermal expansion of the struts 36 is directed, thus helping to reduce or eliminate tensile stress.

In an alternate embodiment of the exhaust case flange 34 and/or the TSC flange 24, the TSC and exhaust case bodies 22,32 include multiple TSC and exhaust case flanges 24,34, respectively, where each flange 24,34 is circumferentially spaced apart from an adjacent flange 24,34. In another possible configuration, the flanges 24,34 are free of preformed holes 35, such that the TSC 20 and the exhaust case 30 are attached together using other mechanical fasteners such as clamps, screws and rivets.

Another feature of the TSC 20 which contributes to the functionalities described above is described with reference to FIGS. 2A and 2B. The TSC flange 24 has a TSC flange radially-outer wall 24C. The TSC flange radially-outer wall 24C is the radially-outer wall of the second portion 24B of the TSC flange 24. The TSC flange radially-outer wall 24C defines an outer diameter of the TSC flange 24. The TSC flange radially-outer wall 24C defines an outer diameter of the TSC 20. The TSC flange radially-outer wall 24C is the radially-outermost wall of the TSC 20. The TSC flange 24 includes reinforced portions 25. The reinforced portion 25 are parts of the TSC flange 24 which are strengthened to better accommodate the radial force RF from the thermal expansion of the struts 36. Each of the reinforced portion 25 are circumferentially aligned with one of the struts 36. By "circumferentially aligned", it is understood that the strut 36 has the same circumferential position, defined about the center axis 11, as some or all of the corresponding reinforced portion 25 of the TSC flange 24. Referring to FIG. 2B, each reinforced portion 25 has a circumferential extent that extends circumferentially on either side of strut 36. The TSC flange 24 includes other, non-reinforced portions 26, that are each disposed circumferentially between adjacent reinforced portions 25. A radial thickness of the TSC flange 24 is defined along a line being radial and perpendicular to the center axis 11 from the outer wall 22B of the TSC body 22 to the TSC flange radially-outer wall 24C. The radial thickness FRT1 of the reinforced portions 25 is greater than the radial thickness FRT2 of the non-reinforced portions 26 (see FIG. 1B). The TSC flange 24 thus has a "thicker" second portion 24B overlapping the exhaust case flange 34 at circumferential locations where the struts 36 are expected to direct the radial force RF, to help distribute the radial thermal load. The thinner, non-reinforced portions 26 of the TSC flange 24 may be referred to as "scalloped" portions 26 of the TSC flange 24.

Yet another feature of the exhaust case 30 which contributes to the functionalities described above is described with reference to FIGS. 1A and 1B. The leading edge portion 38A of the strut 36 has the greatest axial thickness at the outer end 37B, where the axial thickness at the leading edge portion 38A is defined along a line parallel to the center axis 11 between the leading edge 38AL and the portion of the annular wall 36B closest to the leading edge 38AL. The axial thickness AT1 of the leading edge portion 38A is greatest at the outer end 37B of each strut 36. The axial thickness of the leading edge portion 38A is less at locations radially inward from the outer end 37B of each strut 36. The leading edge portion 38A of each strut 36 is thus designed with a variable wall thickness directly in line with the radially-outer exhaust case flange 34. The axially thicker radially outer end 37B of the leading edge portion 38A helps to distribute the thermal radial load from the struts 36 when they undergo thermal expansion. Furthermore, the axially thicker radially outer end 37B of the leading edge portion 38A may increase the mass of the leading edge portion 38A at the outer end 37B and thus stiffen the leading edge portion 38A at this location to help reduce the radial deformation and expansion experienced by the strut 36 at this location. Components which are exposed to high temperatures are typically made thinner to be more flexible to accommodate thermal expansion. However, the leading edge portion 38A at the outer end 37B may be made more massive and stiffer because the necessary flexibility for the mating TSC 20 and exhaust case 30 is transferred to the TSC 20 as explained above. In an embodiment, and referring to FIG. 1B, the axial thickness AT1 of the leading edge portion 38A at the outer end 37B is greater than an axial thickness AT2 of the exhaust case flange 34. The axial thickness AT1 of the leading edge portion 38A at the outer end 37B may be greater than the combined axial thickness of the TSC and exhaust case flanges 24,34. Such a thicker structure for the leading edge portion 38A of the strut 36 at the outer end 37B may take more time to thermally expand and may thus be better at accommodating the transient heating moment. Referring to FIG. 1B, the leading edge 38AL of the strut 36 is joined to the inner wall 32A of the exhaust case body 32 with a fillet radius. Such a gradual increase in the axial thickness of the leading edge portion 38A may provide more mass to dissipate heat.

Yet another feature of the exhaust case 30 which contributes to the functionalities described above is described with reference to FIGS. 1A and 1B. In an embodiment, the TSC 20 is forged or is a forged metal, and the exhaust case 20 or portions thereof are casted metal. During casting of the exhaust case 20, liquid metal is provided to a mold that contains a negative impression of the shape of the exhaust case 20 or components thereof. The metal is cooled and the exhaust case 20 is extracted. This may allow for making the exhaust case flange 34 inflexible. This may allow for making the exhaust case flange 34 stiff such that it does not bend or expand under anticipated loads caused by the radial expansion of the struts 36. This may prevent the exhaust case flange 34 from being displaced into the gas path surrounding the exhaust case body 32 during thermal expansion of the struts 36, such that all thermal deformation that is not absorbed by the heavier struts 36 is transferred to the TSC 20. The stiffness or inflexibility of the exhaust case flange 34 may be a property of the material used for exhaust case flange 34, may be derived from how it is manufactured, or may result from both of these factors.

Referring to FIGS. 1A and 1B, there is disclosed herein a method of assembling a turbine casing of the gas turbine engine 10. The method includes abutting the TSC flange 24 against the exhaust case flange 34 to abut part of the TSC flange 24 against the outer diameter surface of the exhaust case flange 34. This also includes positioning leading edge portions 38A of the struts 36 at positions along the center axis 11 that are similar to a position of the exhaust case flange 34 along the center axis 11. The method includes securing the flanges 24,34 together to assemble the TSC 20 with the exhaust case 30. The assembled TSC and exhaust case 20,30 are configured to displace together with a resiliently deformable portion 23 of the TSC 20 adjacent to the TSC flange 24.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A turbine casing assembly, comprising:

a turbine support case (TSC) having a TSC body defined about a center axis with a TSC flange, the TSC body adjacent to the TSC flange being resiliently deformable; and an exhaust case having an exhaust case body defined about the center axis with an exhaust case flange extending radially outwardly from the exhaust case body to a radially-outer wall defining an outer diameter of the exhaust case flange, the exhaust case flange configured to be secured to the TSC flange by abutting the TSC flange against the radially-outer wall of the exhaust case flange and attaching the TSC to the exhaust case, the exhaust case having struts circumferentially spaced apart about the center axis, each of the struts extending radially from an inner end to an outer end attached to the exhaust case body, each of the struts extending between a leading edge portion and a trailing edge portion, the leading edge portion at the outer end of each of the struts having an axial position (AP1) defined along the center axis that corresponds to an axial position (AP2) of the exhaust case flange;

wherein the TSC flange has a TSC flange radially-outer wall, a radial thickness of the TSC flange defined from the TSC body to the TSC flange radially-outer wall, the TSC flange including reinforced portions each being circumferentially aligned with one of the struts upon the TSC being attached to the exhaust case the TSC flange including other portions each disposed circumferentially between adjacent reinforced portions of the TSC flange, the radial thickness of the TSC flange at the reinforced portions being greater than the radial thickness of the TSC flange at the other portions.

2. The turbine casing assembly of claim 1, wherein the TSC flange includes a first portion extending radially outwardly from the TSC body and a second portion extending axially from the first portion, the second portion configured to abut against the radially-outer wall of the exhaust case flange.

3. The turbine casing assembly of claim 1, wherein the TSC flange is configured to abut against the radially-outer wall of the exhaust case flange along all of a circumferential periphery of the radially-outer wall.

4. The turbine casing assembly of claim 1, wherein the exhaust case flange is a single exhaust case flange being circumferentially continuous about the center axis, and the TSC flange is a single TSC flange being circumferentially continuous about the center axis.

5. The turbine casing assembly of claim 4, wherein the single exhaust case flange includes a plurality of holes extending through the single exhaust case flange and disposed circumferentially about the center axis, a portion of the single exhaust case flange being circumferentially aligned with one of the struts upon the TSC being attached to the exhaust case, the portion of the single exhaust case flange being free of any of the plurality of holes.

6. The turbine casing assembly of claim 1, wherein the leading edge portion of each of the struts has an outer portion at the outer end of the strut and an inner portion extending radially inwardly from the outer portion, an axial thickness of the leading edge portion defined along the center axis between a leading edge of the leading edge portion and an inner wall of the leading edge portion delimiting a cavity of the strut, the axial thickness of the leading edge portion being greatest at the outer portion.

7. The turbine casing assembly of claim 6, wherein the axial thickness of the leading edge portion at the outer portion is greater than an axial thickness of the exhaust case flange.

8. The turbine casing assembly of claim 1, wherein the TSC body adjacent to the TSC flange has a first radial thickness defined between radially inner and outer surfaces of the TSC body, a remainder of the TSC body having a second radial thickness greater than the first radial thickness.

9. The turbine casing assembly of claim 1, wherein the exhaust case flange is inflexible.

10. The turbine casing assembly of claim 1, wherein the TSC is forged and the exhaust case is casted.

11. A gas turbine engine, comprising:

a hot section of the gas turbine engine having a rotor with rotor blades rotatable about a center axis of the gas turbine engine;

a first case with a first case body defined about the center axis and at least partially disposed in the hot section, the first case body having a first case flange and the first case body adjacent to the first case flange being resiliently deformable; and a second case downstream of the first case and having a second case body defined about the center axis with a second case flange extending radially outwardly from the second case body to a radially-outer wall defining an outer diameter of the second case flange, the second case flange secured to the first case flange and the first case flange abutting the radially-outer wall of the second case flange, the second case having struts circumferentially spaced apart about the center axis, each of the struts extending radially from an inner end to an outer end attached to the second case body, each of the struts extending between a leading edge portion and a trailing edge portion, the leading edge portion at the outer end of each of the struts having an axial position (AP1) defined along the center axis corresponding to an axial position (AP2) of the second case flange;

wherein the second case flange includes a plurality of holes extending through the second case flange and disposed circumferentially about the center axis, a portion of the second case flange being circumferentially aligned with the one of the struts, the portion of the second case flange being free of any of the plurality of holes.

12. The gas turbine engine of claim 11, wherein the first case flange includes a first portion extending radially outwardly from the first case body and a second portion extending axially from the first portion, the second portion abutting against the radially-outer wall of the second case flange.

13. The gas turbine engine of claim 11, wherein the first case flange has a first case flange radially-outer wall, a radial thickness of the first case flange defined from the first case body to the first case flange radially-outer wall, the first case flange including reinforced portions being circumferentially aligned with one of the struts, the first case flange including other portions each disposed circumferentially between adjacent reinforced portions of the first case flange, the radial thickness of the first case flange at the reinforced portions being greater than the radial thickness of the first case flange at the other portions.

14. The gas turbine engine of claim 11, wherein the leading edge portion of each of the struts has an outer portion at the outer end of the strut and an inner portion extending radially inwardly from the outer portion, an axial thickness of the leading edge portion defined along the center axis between a leading edge of the leading edge portion and an inner wall of the leading edge portion delimiting a cavity of the strut, the axial thickness of the leading edge portion being greatest at the outer portion.

15. The gas turbine engine of claim 11, wherein the first case body adjacent to the first case flange has a first radial thickness defined between radially inner and outer surfaces of the first case body, a remainder of the first case body having a second radial thickness greater than the first radial thickness.

16. A turbine casing assembly, comprising:

a turbine support case (TSC) having a TSC body defined about a center axis with a TSC flange, the TSC body adjacent to the TSC flange being resiliently deformable; and an exhaust case having an exhaust case body defined about the center axis with an exhaust case flange extending radially outwardly from the exhaust case body to a radially-outer wall defining an outer diameter of the exhaust case flange, the exhaust case flange configured to be secured to the TSC flange by abutting the TSC flange against the radially-outer wall of the exhaust case flange and attaching the TSC to the exhaust case, the exhaust case having struts circumferentially spaced apart about the center axis, each of the struts extending radially from an inner end to an outer end attached to the exhaust case body, each of the struts extending between a leading edge portion and a trailing edge portion, the leading edge portion at the outer end of each of the struts having an axial position (AP1) defined along the center axis that corresponds to an axial position (AP2) of the exhaust case flange;

wherein the leading edge portion of each of the struts has an outer portion at the outer end of the strut and an inner portion extending radially inwardly from the outer portion, an axial thickness of the leading edge portion defined along the center axis between a leading edge of the leading edge portion and an inner wall of the leading edge portion delimiting a cavity of the strut, the axial thickness of the leading edge portion being greatest at the outer portion.

17. A turbine casing assembly, comprising:

a turbine support case (TSC) having a TSC body defined about a center axis with a TSC flange, the TSC body adjacent to the TSC flange being resiliently deformable; and an exhaust case having an exhaust case body defined about the center axis with an exhaust case flange extending radially outwardly from the exhaust case body to a radially-outer wall defining an outer diameter of the exhaust case flange, the exhaust case flange configured to be secured to the TSC flange by abutting the TSC flange against the radially-outer wall of the exhaust case flange and attaching the TSC to the exhaust case, the exhaust case having struts circumferentially spaced apart about the center axis, each of the struts extending radially from an inner end to an outer end attached to the exhaust case body, each of the struts extending between a leading edge portion and a trailing edge portion, the leading edge portion at the outer end of each of the struts having an axial position (AP1) defined along the center axis that corresponds to an axial position (AP2) of the exhaust case flange;

wherein the exhaust case flange is a single exhaust case flange circumferentially continuous about the center axis, and the TSC flange is a single TSC flange circumferentially continuous about the center axis, and wherein the single exhaust case flange includes a plurality of holes extending through the single exhaust case flange and disposed circumferentially about the center axis, a portion of the single exhaust case flange being circumferentially aligned with one of the struts upon the TSC being attached to the exhaust case, the portion of the single exhaust case flange being free of any of the plurality of holes.

* * * * *